United States Patent [19]

Begley

[11] Patent Number: 4,796,770

[45] Date of Patent: Jan. 10, 1989

[54] MOLDED PLASTIC CLOSURE WITH SPLIT SKIRT TAMPERBAND

[75] Inventor: Douglas G. Begley, Palatine, Ill.

[73] Assignee: Continental White Cap, Inc., Northbrook, Ill.

[21] Appl. No.: 104,075

[22] Filed: Oct. 5, 1987

[51] Int. Cl.[4] ..... B65D 41/34

[52] U.S. Cl. ..... 215/252; 215/253

[58] Field of Search ..... 215/252, 253, 258

[56] References Cited

U.S. PATENT DOCUMENTS

| | | | |
|---|---|---|---|
| 4,196,818 | 4/1980 | Brownbill | 215/252 |
| 4,206,851 | 6/1980 | Ostrowsky | 215/252 X |
| 4,305,516 | 12/1981 | Perne et al. | 215/252 |
| 4,394,918 | 7/1983 | Grussen | 215/252 X |
| 4,458,821 | 7/1984 | Ostrowsky | 215/252 |
| 4,458,822 | 7/1984 | Ostrowsky | 215/252 |
| 4,511,053 | 4/1985 | Brandes et al. | 215/252 |
| 4,526,282 | 7/1985 | Dutt et al. | 215/252 |
| 4,546,892 | 10/1985 | Couput | 215/252 |
| 4,653,657 | 3/1987 | Paparasilopoulos | 215/252 |

*Primary Examiner*—Stephen Marcus
*Assistant Examiner*—Nova Stucker
*Attorney, Agent, or Firm*—Charles E. Brown; Paul Shapiro; Charles A. Brown

[57] ABSTRACT

An injection molded plastic closure having a tamper indicating portion. The tamper indicating portion includes a tampering indicating band which is attached to the skirt for radially outward hinging by a plurality of bridges. The tamper indicating band is subject to splitting whereby it may expand outwardly and clear a container neck finish. The tamper indicating band remains attached to the closure and the splitting thereof indicates tampering. Bridges attaching the tamper indicating band to the closure skirt are of sufficient cross section to have the required structural strength to prevent separation of the tamper indicating band from the closure skirt and at the same time permit injected molten plastic to freely flow from the closure skirt into the tamper indicating band. The tamper indicating band carries a plurality of locking flaps which are attached thereto by hinges which are defined by external areas of weakness which are shaped to be defined by a mold member which does not interlock with the closure and provides for ease of stripping.

12 Claims, 1 Drawing Sheet

MOLDED PLASTIC CLOSURE WITH SPLIT SKIRT TAMPERBAND

This invention relates in general to new and useful improvements in molded plastic closures and more particularly to molded plastic closures of the type which include a tamper indicating band that is secured to the skirt of the closure by way of a plurality of circumferentially spaced bridges and wherein the band carries lugs or flaps which are lockable beneath a locking bead on a container neck finish.

Molded plastic closures of this type have several problems including the effective injection molding thereof and the removal from the associated injection mold without damaging the closure.

In addition to the formation problems, the closure must be one which can be readily applied to a container and which will function to indicate tampering when the closure is being removed from the container.

A typical example of the prior art is found in the patent to Dutt et al U.S. Pat. No. 4,526,282 which discloses an injection molded plastic closure and the injection mold for forming the same. A very complex mold is required and in addition to an external stripping action, there must be a center stripping action to relieve the closure of interlocking engagement with an associated mold core.

Further, the relatively heavy tamper indicating band and the associated lugs carried thereby must be connected to the lower edge of the skirt portion of the closure by way of a plurality of bridges. These bridges are relatively shallow in cross section and frequently the plastic flow through the areas of the bridges into the tamper indicating band and the associated lugs is not sufficient for there to be a proper formation of the closure tamper indicating feature.

In accordance with this invention, it is proposed to form a molded plastic closure wherein the bridges connecting the tamper indicating band to the closure skirt are of a greater cross section than usual and wherein the bridges are utilized to permit radially outward pivoting of the tamper indicating band as opposed to being rupturable so as to effect separation of the tamper indicating band from the closure when the closure is removed from an associated container.

Another feature of the invention is that the tamper indicating band is provided with flaps which are hingedly connected thereto and which in use swing radially outwardly so as to rupture a weakened area in the tamper indicating band and to effect the radially outward swinging of the tamper indicating band as opposing to locking the tamper indicating band to the container neck finish.

Yet a further feature of the invention is the connection between the flaps and the tamper indicating band wherein a hinge is provided between each flap and the tamper indicating band by an external weakening area which provides no interlock with an associated mold when formed, all of the weakening area being disposed radially outwardly of a cylindrical reference and below a planar reference.

With the above and other objects in view that will hereinafter appear, the nature of the invention will be more clearly understood by reference to the following detailed description, the appended claims, and the several views, illustrated in the accompanying drawings.

Figure 1:
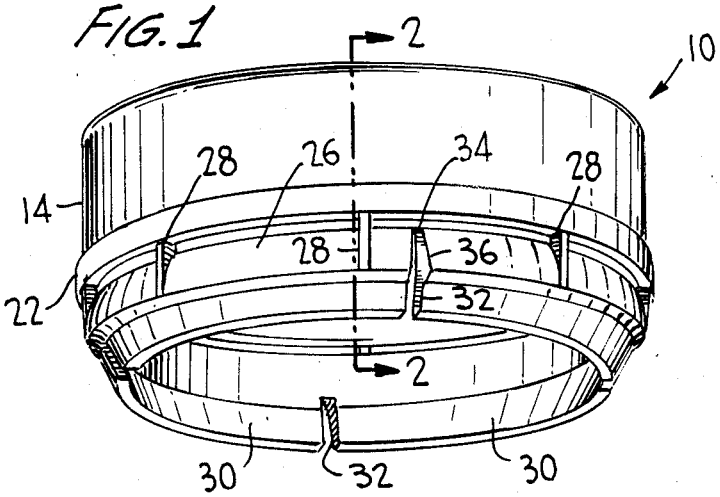
FIG. 1 is a bottom perspective view of the closure which is the subject of this invention and shows generally the details thereof.

Referring now to the drawings in detail, it will be seen that there is illustrated the closure which is the subject of this invention, the closure being generally identified by the numeral 10. The closure 10 is of an injection molded plastic construction and includes an inverted cup-shaped primary portion 12 which includes a generally cylindrical skirt 14 and an inner end panel 16. The skirt 14 is preferably provided with internal threads 18 for locking engagement with a threaded container neck finish as will be described in detail hereinafter. The underside of the end panel 16 is provided with suitable sealing means in the form of a depending rib 20 for sealing engagement with a container end sealing surface as will also be described in detail hereinafter.

If desired, the lower part of the skirt 14 may be provided with a radially outwardly projecting stiffening or reinforcing rib 22.

The cup-shaped portion 12, as described above, in of itself does not constitute part of this invention. The invention relates to a lower tamper indicating portion 24 which depends from the lower edge of the skirt 14. The tamper indicating portion 24 includes a tamper indicating band 26 which is spaced from and connected to the lower edge of the skirt 14 by a plurality of circumferentially spaced bridges 28. There is depending from and hingedly connected to the lower edge of the tamper indicating band 26 a plurality of flaps 30 which are separated circumferentially by notches 32 so as to function independently.

Figure 2:
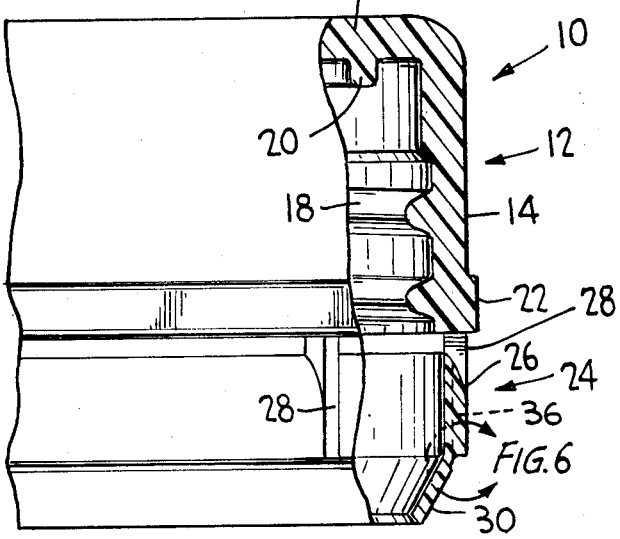
FIG. 2 is an enlarged fragmentary elevational view with parts broken way and shown in section along the line 2—2 of FIG. 1.

As is best shown in FIG. 2, the cross section of the tamper indicating band 26 is such that it is of a maximum width at the bottom thereof and gradually decreases in thickness externally to a minimal, substantially no thickness, at the top thereof. The tamper indicating band, 26, as is best indicated in FIG. 1, is provided with a line of weakness 34. The line of weakness 34 extends axially and is aligned with one of the notches 32. The line of weakness 34 is formed by a generally V-shaped notch 36 which is shown by dotted lines in FIG. 2.

Figure 5:
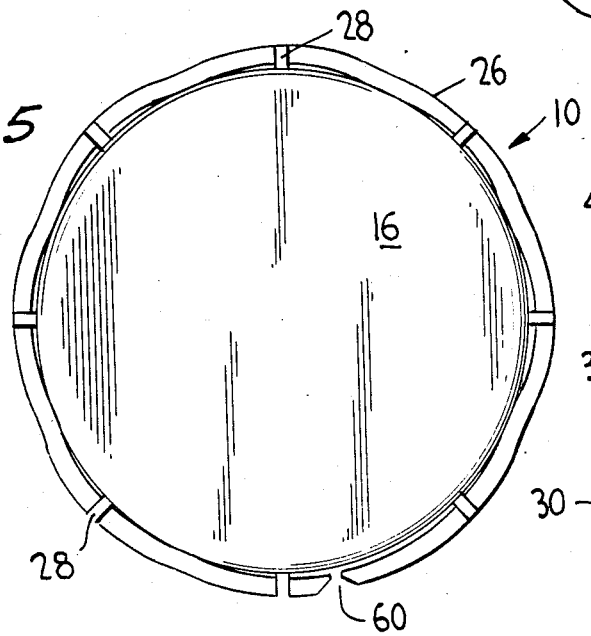
FIG. 5 is a top plan view of the closure as is appears in FIG. 4 and shows the rupture and outward swinging of the tamper indicating band.

Considering next the bridges 38, it will be seen that notwithstanding the fact that the tamper indicating band 26 decreases in thickness axially, the bridges 28 are of a constant full width corresponding to the width of the base of the tamper indicating band 26. This is clearly shown in FIGS. 1 and 2. It is to be understood that the cross section of the bridges 28 is greater than normal in that the bridges 28 are not intended to rupture when the closure 10 is removed, but merely to facilitate outward bending and expansion of the tamper indicating band 26 after the tamper indicating band 26 has ruptured along the line of weakening 34. This ruptured condition is best shown in FIG. 5.

Figure 6:
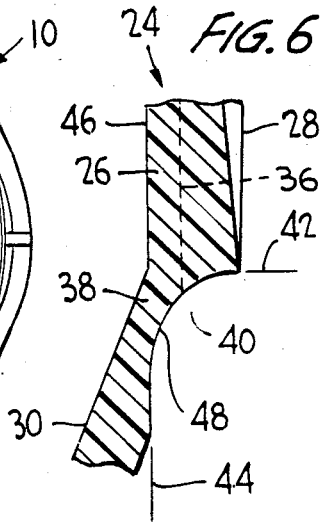
FIG. 6 is an enlargement of the designated area of FIG. 2 showing the specific hinged connection between a flap and the tamper indicating band.

The flaps 30, when initially molded, are frustoconical in configuration as is also best shown in FIGS. 1 and 2. Each flap 30 is hingedly connected to the bottom edge of the tamper indicating band 26 by way of a hinge 38 which is best shown in FIG. 6. The hinge 38 is defined by an area of weakness 40 which is generally bounded at the top by a transverse plane 42 which defines the bottom edge of the tamper indicating band 26 and by a cylindrical reference 44 which may be aligned with a cylindrical inner surface 46 of the tamper indicating band 26. A central portion of the hinge 38 is defined by a radius portion of an annulus 48 which extends between the cylindrical reference 44 and the plane 42.

While the details of a mold member for defining the area of weakness 40 have not been specifically illustrated, it is to be understood that the mold member will have a configuration corresponding to the area of weakness 40 and since no portion of that mold member will have any interlocking engagement with the closure 10, the mold member may be readily axially withdrawn downwardly relative to a newly injection molded closure 10 without interference. Thereafter, the flaps 30, which are hingedly mounted, may then swing radially outwardly so as to clear the required internal mold core (not shown).

At this time it is particularly pointed out that in view of the fact that the bridges 28 are not intended to rupture and thus may be of a greater than normal cross section, the bridges 28 define adequate flow paths for the molten plastic to pass downwardly in an associated injection mold from the skirt 14 into the portions of the mold defining the tamper indicating band 26 and the flaps 30. Thus in every instance, the bridges 28 will be fully formed. This advantage, together with the fact that the flaps 30 in no way retard the stripping of the injection molded closure from an associated mold core, provides an advantageous construction which permits the closure 10 to be more readily formed with greater certainty and thus the closure 10 is less expensive to manufacture than corresponding closures of the general type to which this invention relates.

It is to be understood that the closure 10 is illustrated in FIGS. 1 and 2 in its as molded state and that while the flaps 30 will swing to generally cylindrical positions when the closure 10 is stripped from the mold core, the flaps 30 will return to the as molded positions.

If desired, the flaps 30 may be pushed to radially inwardly and axially upwardly projecting positions before the closure 10 is assembled with the neck finish of a container. On the other hand, the closure 10, as illustrated in FIGS. 1 and 2, may be applied directly to a container neck finish with the result that the flaps 30 will hinge upwardly and radially inwardly relative to the tamper indicating band 26.

Figure 3:
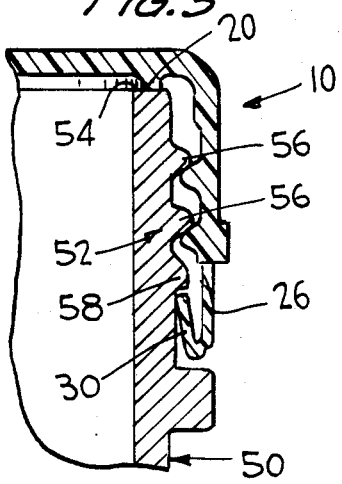
FIG. 3 is a vertical sectional view through the neck finish of a container which is sealed closed by the closure.
Figure 4:
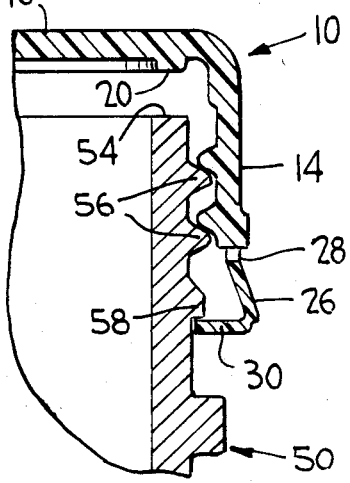
FIG. 4 is a vertical sectional view similar to FIG. 3 and shows the closure in the act of being removed with a flap hinging relative to the tamper indicating band and effecting radially outward swinging of the tamper indicating band.

Reference is now made to FIGS. 3 and 4 wherein there is illustrated a container 50 having a neck finish 52. The neck finish 52 includes an upper endmost sealing surface 54 with which the sealing rib 20 is engaged to seal the container 50.

In order that the closure 10 may be lockingly engaged with the neck finish 52, the upper exterior portion of the neck finish 52 includes threads 56. Below the threads 56 is an annular locking bead 58 which serves to retain the tamper indicating band 26 on the neck finish 52.

It is to be understood that when a closure 10 is applied to a container 50, the flanges 30 will fold to positions alongside the interior of the tamper indicating band 26 without undue resistance so as to pass down over the threads 56 and the locking rib or bead 58. Thus when the closure 10 is fully seated on the container 50, the flanges 30 will assume the upstanding position illustrated in FIG. 3 beneath the locking rib or bead 58.

When the closure 10 is to be removed by unthreading, as it moves axially upwardly on the neck finish 52, since the bridges 28 are of sufficient strength to resist rupture, the flaps 30 will pivot about the underside of the locking rib or bead 58, as shown in FIG. 4, forcing the lower portion of the tamper indicating band 26 radially outwardly with the tamper indicating band 26 hinging relative to the skirt 14 in the manner best shown in FIG. 4. This results in an expansion of the tamper indicating band 26 and the resultant rupture thereof along the line of weakness 34 to assume a condition as is best shown in FIG. 5 wherein the rupture is identified by the numeral 60.

The tamper indicating band 26, having ruptured and having hinged radially outwardly as shown in FIG. 4, as the closure 10 is further removed, the flaps 30 wil continue to pivot relative to the locking rib or bead 58 and assume downwardly and radially inwardly sloping positions wherein they will freely slide over the locking rib or bead 58 and the threads 56. Thus the tamper indicating band 26 will remain with the closure. When the container 50 is to be resealed by the closure 10, the flaps 30 will freely pass down over the threads 56 and the locking rib or bead 58 while the rupture 60 of the tamper indicating band 26 will indicate the fact that the closure 10 has been moved relative to the container 50 sufficiently to unseal the container 50 and thus indicate tamper.

Although only a preferred embodiment of the closure and the advantageous construction of the tamper indicating portion thereof have been specifically illustrated and described herein, it is to be understood that minor variations may be made in the closure without departing from the spirit and scope of the invention as defined by the appended claims.

I claim:

1. A molded plastic closure comprising an inverted cup-shaped part including a skirt and an end panel, means for attachment to a container carried by said skirt, and tamper indicating means carried by said skirt in depending relation, said tamper indicating means including a tamper indicating band permanently hingedly connected to said skirt, for radially outward expansion, said tamper indicating band having formed therein at least one axial line of weakening forming means wherein said tamper indicating band is subject to axial splitting and radial expansion in response to radially outwardly directed forces, and a plurality of separate flaps hingedly connected to said tamper indicating band remote from said skirt, hinge connections between said flaps and said tamper indicating band permitting generally reverse folding of said flaps from a downwardly directed position to an upstanding position whereby free edges of said flaps may engage a retaining bead on a container neck finish and swing towards a transverse intermediate position during removal of said closure hinging said tamper indicating band radially outwardly to permit complete removal of said closure.

2. A closure according to claim 1 wherein said hinge connections are defined by lines of reduced thickness.

3. A closure according to claim 1 wherein said flaps in an as molded state of said closure slope downwardly and radially inwardly, and each of said hinge connections is defined by a radially outer weakening area.

4. A closure according to claim 1 wherein said flaps in an as molded state of said closure slope downwardly and radially inwardly,and each of said hinge connections is defined by a radially outer weakening area which opens radially outwardly and axially downwardly to facilitate molding.

5. A closure according to claim 4 wherein substantially all of said weakening cylindrical reference.

6. A closure according to claim 4 wherein substantially all of said weakening area is disposed radially outwardly of a cylindrical reference which forms a continuation of a radially inner surface of said tamper indicating bead.

7. A closure according to claim 4 wherein substantially all of said weakening area is below a transverse plane.

8. A closure according to claim 4 wherein substantially all of said weakening area is below a transverse plane passing through a line of intersection between said tamper indicating band and each of said flaps.

9. A closure according to claim 1 wherein said flaps are separated by notches, and said axial line of weakening is aligned with one of said notches.

10. A closure according to claim 1 wherein said tamper indicating means is connected to said skirt by circumferentially spaced bridges, and each of said bridges extends radially outwardly of said tamper indicating band to facilitate injection molding of said closure.

11. A closure according to claim 10 wherein said tamper indicating band tapers in radial thickness from said flaps towards said skirt.

12. A closure according to claim 10 wherein said tamper indicating band tapers externally in radial thickness from said flaps towards said skirt.

* * * * *